US011244631B2

(12) United States Patent
Rha et al.

(10) Patent No.: US 11,244,631 B2
(45) Date of Patent: Feb. 8, 2022

(54) DISPLAY DEVICE

(71) Applicant: LG DISPLAY CO., LTD., Seoul (KR)

(72) Inventors: Sunghoon Rha, Paju-si (KR); Hyungguk Bae, Paju-si (KR); Minsu Cho, Paju-si (KR); Minkyu Jang, Paju-si (KR)

(73) Assignee: LG DISPLAY CO., LTD., Seoul (KR)

( * ) Notice: Subject to any disclaimer, the term of this patent is extended or adjusted under 35 U.S.C. 154(b) by 96 days.

(21) Appl. No.: 16/706,271

(22) Filed: Dec. 6, 2019

(65) Prior Publication Data

US 2020/0202790 A1 Jun. 25, 2020

(30) Foreign Application Priority Data

Dec. 20, 2018 (KR) ..... 10-2018-0166070

(51) Int. Cl.
*G09G 3/3275* (2016.01)
*G09G 3/20* (2006.01)

(52) U.S. Cl.
CPC ..... *G09G 3/3275* (2013.01); *G09G 3/2003* (2013.01); *G09G 3/2007* (2013.01); *G09G 2310/027* (2013.01); *G09G 2310/0297* (2013.01); *G09G 2310/08* (2013.01); *G09G 2320/064* (2013.01); *G09G 2320/0633* (2013.01); *G09G 2320/0673* (2013.01); *G09G 2330/028* (2013.01)

(58) Field of Classification Search
CPC combination set(s) only.
See application file for complete search history.

(56) References Cited

U.S. PATENT DOCUMENTS 9,378,707 B2 6/2016 Lee
2005/0023986 A1* 2/2005 Mizukoshi ..... G09G 3/3208 315/169.3
2005/0052350 A1* 3/2005 Mizukoshi ..... G09G 3/3233 345/55
2013/0249955 A1* 9/2013 Kim ..... G09G 3/3233 345/690
2014/0184657 A1* 7/2014 Lee ..... G09G 3/3208 345/690
2015/0179103 A1* 6/2015 Tani ..... G09G 3/20 345/690
2017/0053581 A1* 2/2017 Jung ..... G09G 5/10

FOREIGN PATENT DOCUMENTS

KR 10-2014-0085169 A 7/2014

* cited by examiner

*Primary Examiner* — Temesghen Ghebretinsae
*Assistant Examiner* — Sosina Abebe
(74) *Attorney, Agent, or Firm* — Birch, Stewart, Kolasch & Birch, LLP

(57) ABSTRACT

A display device includes a display panel including data lines, gate lines which cross the data lines, and pixels; a gamma voltage generator configured to generate first to nth gamma voltages, n being an integer; and a data driver configured to generate data voltages by selecting the gamma voltages according to input image data, and to supply the data voltages to the data lines, wherein the gamma voltage generator comprises a first voltage dividing unit configured to divide a reference voltage; a first voltage dividing circuit configured to generate the first gamma voltage by selecting voltages output from the first voltage dividing unit according to a highest gamma register value; and a second voltage dividing circuit configured to generate the second to nth gamma voltages using the reference voltage.

20 Claims, 7 Drawing Sheets

DISPLAY DEVICE

This application claims the priority benefit of Korean Patent Application No. 10-2018-0166070 filed in the Republic of Korea on Dec. 20, 2018, which is incorporated herein by reference for all purposes as if fully set forth herein.

BACKGROUND OF THE INVENTION

Field of the Invention

The present disclosure relates to a display device, and more particularly to the display device capable of adjusting a data voltage for black gradation.

Discussion of the Related Art

A flat panel display device includes a liquid crystal display LCD, an electroluminescence display, a field emission display FED, a quantum dot display panel QD and the like. The electroluminescent display is divided into an inorganic light emitting display and an organic light emitting display depending on the material of a light emitting layer. The pixels of the organic light emitting display device display image data using an organic light emitting diode OLED.

A driving circuit of the flat panel display device includes a data driver for converting digital data of input video into data voltages for driving pixels and for driving data lines, and a gate driver for outputting gate signals synchronized with the data voltages to gate lines. The data driver converts the digital data into the data voltages using a digital-to-analog converter DAC. The DAC outputs the data voltage by converting the digital data into a gamma voltage.

Different gamma voltages are used depending on the data voltages written to the red R, green G, and blue B pixels. However, even if different gamma voltages are used for R, G, and B colors, the same voltage value is used for all black gamma voltages for representing black gradation. Thus, it is necessary to improve the design of the gamma voltage use in order to improve power consumption and image quality.

SUMMARY OF THE INVENTION

The present disclosure has been made in view of the above circumstances. It is an object of the present disclosure to provide a display device that generates gamma voltages so as to improve power consumption and image quality.

The display device of the present disclosure can comprise a display panel, a gamma voltage generator and a data driver. The display panel is equipped with data lines, gate lines which cross the data lines, and pixels. The gamma voltage generator generates first to nth gamma voltages. The data driver generates data voltages by selecting the gamma voltages according to input image data and supplies the data voltages to the data lines. The gamma voltage generator comprises a first voltage dividing unit for dividing a first reference voltage, a first voltage dividing circuit for generating the first gamma voltage by selecting the voltages output from the first voltage dividing unit according to a highest gamma register value, and a second voltage dividing circuit for generating the second to nth gamma voltages by dividing the first reference voltage.

According to an embodiment, the present disclosure provides a display device which comprises a display panel including data lines, gate lines which cross the data lines, and pixels; a gamma voltage generator configured to generate first to nth gamma voltages, n being an integer; and a data driver configured to generate data voltages by selecting the gamma voltages according to input image data, and to supply the data voltages to the data lines, wherein the gamma voltage generator comprises a first voltage dividing unit configured to divide a reference voltage; a first voltage dividing circuit configured to generate the first gamma voltage by selecting voltages output from the first voltage dividing unit according to a highest gamma register value; and a second voltage dividing circuit configured to generate the second to nth gamma voltages using the reference voltage.

According to an embodiment, the present disclosure provides a driving device for driving a display device including a red (R) pixel, a green (G) pixel, and a blue (B) pixel, the driving device comprising a gamma voltage generator configured to generate a plurality of gamma voltages, wherein the gamma voltage generator includes an R gamma voltage generator, a G gamma voltage generator, and a B gamma voltage generator, and wherein the R, G and B gamma voltage generators generate respectively R, G and B highest gamma voltages, and the R, G and B highest gamma voltages are different from each other; and a data driver configured to generate a first black data voltage, a second black data voltage, and a third black data voltage respectively based on the R, G and B highest gamma voltages, and supply the first, second and third black data voltages respectively to the R, G and B pixels.

The details of the embodiments of the present disclosure are included in the detailed description and drawings.

According to one or more embodiments of the present disclosure, since the highest gamma voltage for representing black gradation is generated based on a first gamma register value, the magnitude of a black data voltage can be varied. By varying the magnitudes of the black data voltages provided to R, G, and B pixels, it is possible to prevent consuming more power than necessary.

Further, according to one or more embodiments of the present disclosure, by varying the highest gamma voltage according to the brightness displayed by a display panel, it is possible to reduce power consumption while minimizing the degradation of gradation representation capability.

BRIEF DESCRIPTION OF THE DRAWINGS

The accompanying drawings, which are included to provide a further understanding of the invention and are incorporated in and constitute a part of this specification, illustrate embodiments of the invention and together with the description serve to explain the principles of the invention. In the drawings.

DETAILED DESCRIPTION OF THE EMBODIMENTS

Figure 1:
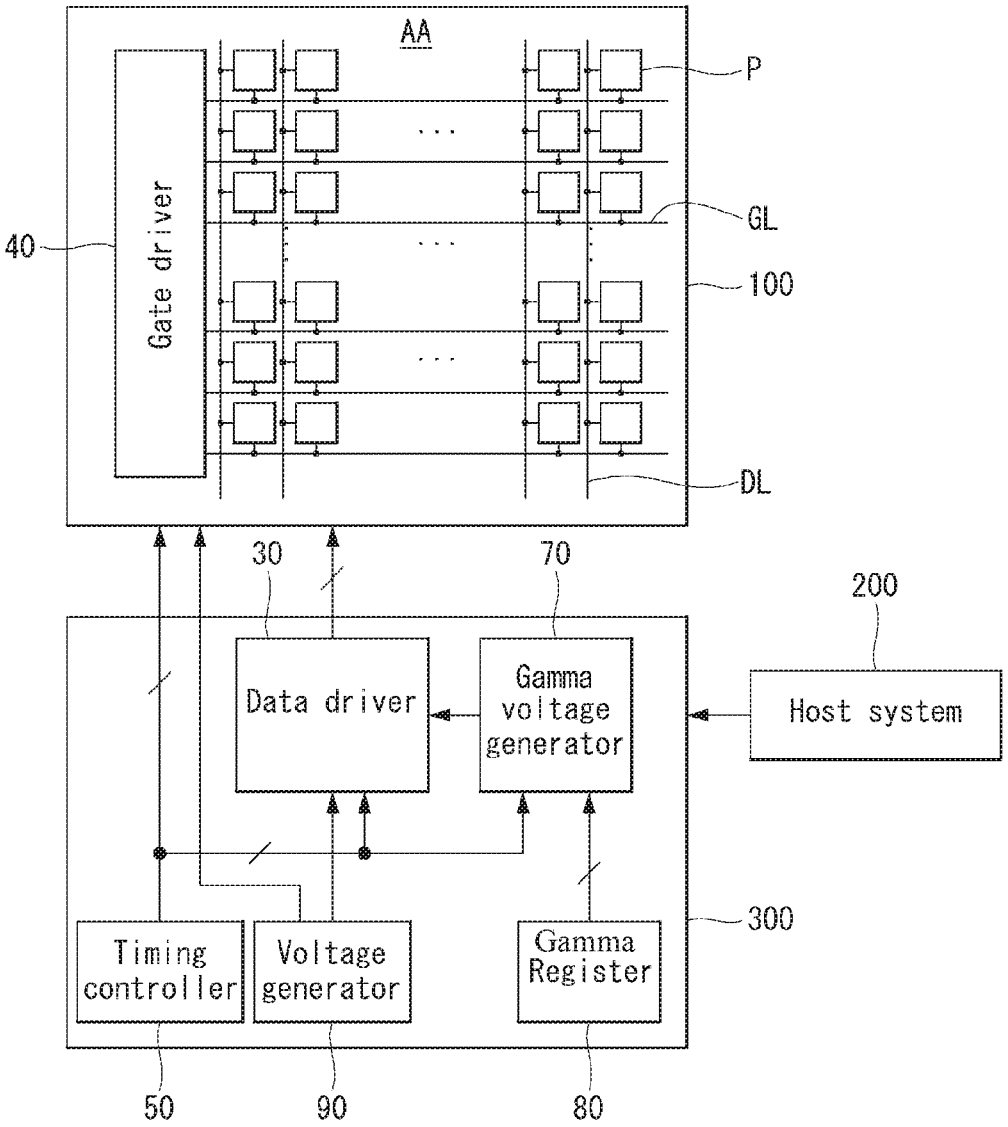
FIG. 1 shows a display device according to the present disclosure.

The advantages and features of the present invention and methods of accomplishing the same can be understood more readily by reference to the following detailed descriptions of exemplary embodiments and the accompanying drawings. The present invention may, however, be embodied in many different forms and should not be construed as being limited to the exemplary embodiments set forth herein. Rather, these exemplary embodiments are provided so that this disclosure will be thorough and complete and will fully convey the concept of the present invention to those skilled in the art, and the present invention is defined by the appended claims.

The shapes, sizes, percentages, angles, numbers, etc. shown in the figures to describe the exemplary embodiments of the present invention are merely examples and not limited to those shown in the figures. Like reference numerals denote like elements throughout the specification. In describing the present invention, detailed descriptions of related well-known technologies will be omitted to avoid unnecessary obscuring the present invention. When the terms 'comprise', 'have', 'consist of' and the like are used, other parts can be added as long as the term 'only' is not used. The singular forms can be interpreted as the plural forms unless explicitly stated.

The elements can be interpreted to include an error margin even if not explicitly stated.

When the position relation between two parts is described using the terms 'on', 'over', 'under', 'next to' and the like, one or more parts can be positioned between the two parts as long as the term 'immediately' or 'directly' is not used.

It will be understood that, although the terms first, second, etc., can be used to describe various elements, these elements should not be limited by these terms. These terms are only used to distinguish one element from another element. Thus, a first element referred to below can be a second element within the scope of the present disclosure.

Hereinafter, various embodiments of the present invention will be described in detail with reference to the accompanying drawings.

FIG. 1 shows a display device according to the present disclosure. All the components of the display device according to all embodiments of the present disclosure are operatively coupled and configured.

Referring to FIG. 1, the display device of the present disclosure includes a display panel 100, a driving circuit/device 300 for writing pixel data of input image to pixels of the display panel 100, a host system 200, and the like.

The display panel 100 reproduces input image through a display unit AA. The display unit AA of the display panel 100 includes data lines DL, gate lines GL which intersect the data lines DL and a pixel array in which pixels P are arranged in a matrix form. The data lines DL supply data voltages from the driving circuit 300 to the pixels P. The gate lines GL supply gate signals from the gate driver 40 to the pixels P. The gate driver 40 can be part of the display panel 100 or can be included in the driving circuit 300.

In this specification, each pixel P refers to any one of R, G, and B pixels for color representation or to any one of R, G, B and W (white) pixels. Each pixel P can be implemented with the pixel configuration shown in FIG. 2 or 8, and a compensation circuit CC shown in FIG. 2 or 8 may be any known configuration.

The pixel array in the display panel 100 includes a plurality of transistors. The transistors can be implemented as one or more of thin film transistors TFTs including oxide semiconductor, TFTs including amorphous silicon a-Si, TFTs including low temperature polysilicon LTPS and the like. The TFT can be implemented by a metal oxide semiconductor field effect transistor MOSFET structure. The TFT can be implemented as one of an n-type transistor NMOS or a p-type transistor PMOS or a combination thereof.

The data driver 30 is provided with the image data of a digital form, and converts the image data into the data voltage of an analog form by using the gamma voltages supplied from the gamma voltage generator 70. The data voltages output from the data driver 30 are supplied to the pixels through the data lines DL.

The gate driver 40 includes a shift register. The shift register includes a plurality of stages connected in a cascaded manner and supplies gate signals to the gate lines GL by shifting the output voltages of respective stages in synchronization with gate shift clock timings. In the present disclosure, the gate driver 40 is shown to be mounted in the form of gate in panel GIP on the display panel 100, but can be implemented outside the display panel 100 in the form of a drive IC.

The driving circuit 300 comprises a timing controller 50, the data driver 30, the gamma voltage generator 70, a gamma register 80, a voltage generator 90, and the like.

The timing controller 50 generates timing control signals for controlling the operating timings of the gate driver 40 and the data driver 30 using the timing signals received from a host system 200 such as a vertical synchronization signal Vsync, a horizontal synchronization signal Hsync, a dot clock CLK, and a data enable signal DE. The host system 200 can be one of a television device/system, a set-top box, a navigation device/system, a personal computer PC, a computer, a laptop, an internet-based device, a home theater device/system, a mobile device/system, user equipment, a wearable device/system, and a virtual reality device/system, or any other application device or electronic device.

The gamma voltage generator 70 outputs the gamma voltages according to the gamma register values stored in the gamma register 80. The gamma register values stored in the register 80 are divided into different values depending on gamma bands. The gamma band can be selected according to a digital brightness value DBV input from the host system 200. The digital brightness value DBV indicates the maximum gradation value of the pixel data, for example, the brightness corresponding to the gradation 255 in the case of 8-bit data. The digital brightness value DBV can be determined by a user command input from a user through a user interface connected to the host system 200 or can be determined based on one or more of the sensing values of various sensors by the host system 200.

The voltage generator 90 generates power needed for driving the display panel 100. The voltage generator 90 outputs power source voltages needed for driving the pixels P of the display panel 100, for example, VDDEL, VGH, VGL, Vref, and analog gamma voltages. Here, VDDEL is a high potential driving voltage applied to the pixel P, VGH is a gate high voltage, and VGL is a gate low voltage.

Figure 2:
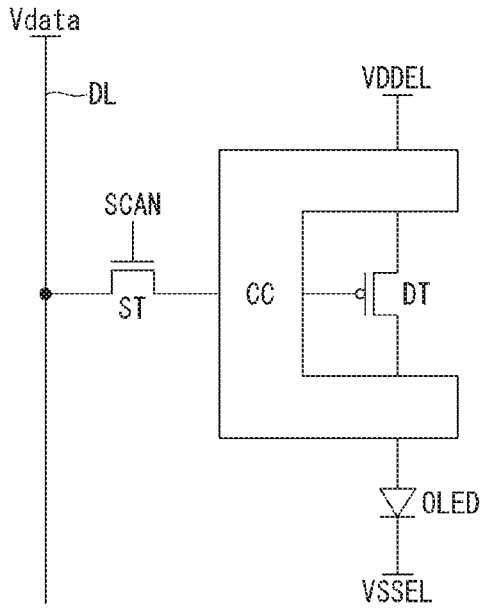
FIG. 2 shows an example of a pixel structure according to the present disclosure.

FIG. 2 shows an embodiment of a pixel structure according to the present disclosure. Hereinafter, although the embodiment in this specification is described with reference to an organic light emitting display device, the embodiment of the present disclosure can be applied to a flat panel display device such as a liquid crystal display device.

Referring to FIG. 2, the pixel (e.g., P in FIG. 1) according to the embodiment of the present disclosure comprises an organic light emitting diode OLED, a driving transistor DT, a scan transistor ST, and a compensation circuit CC.

The OLED includes an organic compound layer located between an anode electrode and a cathode electrode. The driving transistor DT controls the driving current applied to the OLED according to its source-gate voltage Vsg. The scan transistor ST provides a data voltage to the compensation circuit CC in response to the scan signal SCAN. The compensation circuit CC can be implemented as an internal compensation circuit for compensating for the threshold voltage of the driving transistor DT in real time within an image display period. Or, the compensation circuit CC can be implemented as an external compensation circuit to sense the threshold voltage of the driving transistor DT within a predetermined period other than the image display period and to compensate for the image data based on the sensed threshold voltage.

Figure 3:
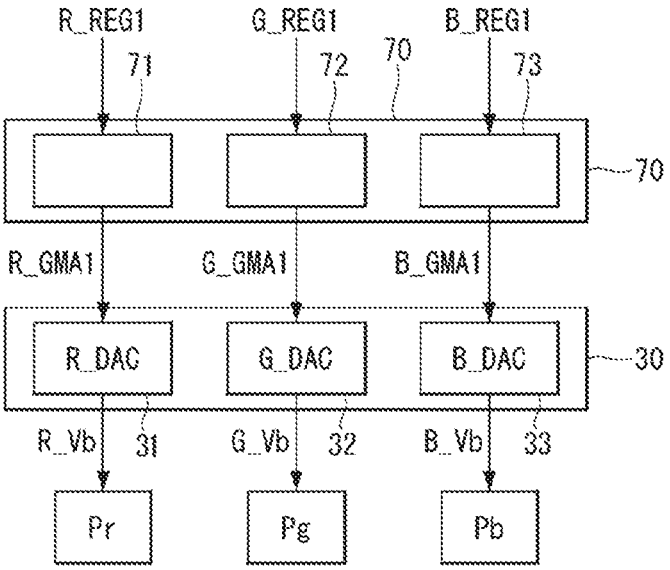
FIG. 3 is a block diagram showing a configuration of a gamma voltage generator and a data driver according to the present disclosure.

FIG. 3 is a block diagram showing a configuration of a gamma voltage generator and a data driver according to the present disclosure. In particular, FIG. 3 is a diagram for explaining a process of generating a highest gamma voltage among the gamma voltages generated by the gamma voltage generator.

Referring to FIG. 3, the gamma voltage generator 70 comprises an R gamma voltage generator 71, a G gamma voltage generator 72 and a B gamma voltage generator 73.

The R gamma voltage generator 71 generates the R highest gamma voltage R_GMA1 using the highest gamma register value R_REG1. Similarly, the G gamma voltage generator and the B gamma voltage generator respectively generate the G and B highest gamma voltages G_GMA1 and B_GMA1 using the highest gamma register values G_REG1 and B_REG1, respectively.

The data driver 30 includes an R_DAC 31, a G_DAC 32 and a B_DAC 33. The R_DAC 31 generates a black data voltage R_Vb to be supplied to R pixels Pr based on the R highest gamma voltage R_GMA1. Similarly, the G_DAC 32 generates a black data voltage G_Vb to be supplied to G pixels Pg based on the G highest gamma voltage G_GMA1, and the B_DAC 33 generates a black data voltage B_Vb to be supplied to B pixels Pb based on the B highest gamma voltage B_GMA1.

Adjacent R, G and B pixels Pr, Pg and Pb display black image based on the black data voltages R_Vb, G_Vb and B_Vb.

Since the R gamma voltage generator 71, the G gamma voltage generator 72 and the B gamma voltage generator use the individual highest gamma register values R_REG1, G_REG1, and B_REG1, the highest gamma voltages R_GMA1, G_GMA1, and B_GMA1 output by the respective gamma voltage generators 71, 72, and 73 can be designed to have different voltage values.

Figure 4:
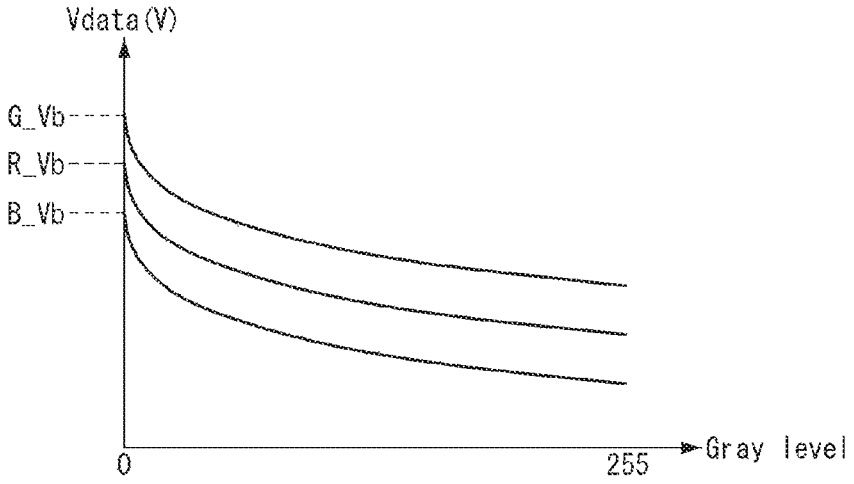
FIG. 4 shows black data voltages according to gray levels according to the present disclosure.

As a result, as shown in FIG. 4, the black data voltages R_Vb, G_Vb, and B_Vb output respectively from the R_DAC 31, the G_DAC 32, and the B_DAC 33 have different voltage values from each other according to the present invention.

In comparison, a gamma voltage generator according to a related art sets the highest gamma voltages of R, G, and B for generating the black data voltages to be equal to each other. Therefore, the related art gamma voltage generator does not need to generate the highest gamma voltage using a gamma register value, but outputs the R highest gamma voltage, the G highest gamma voltage, and the B highest gamma voltage at a same magnitude.

Figure 5:
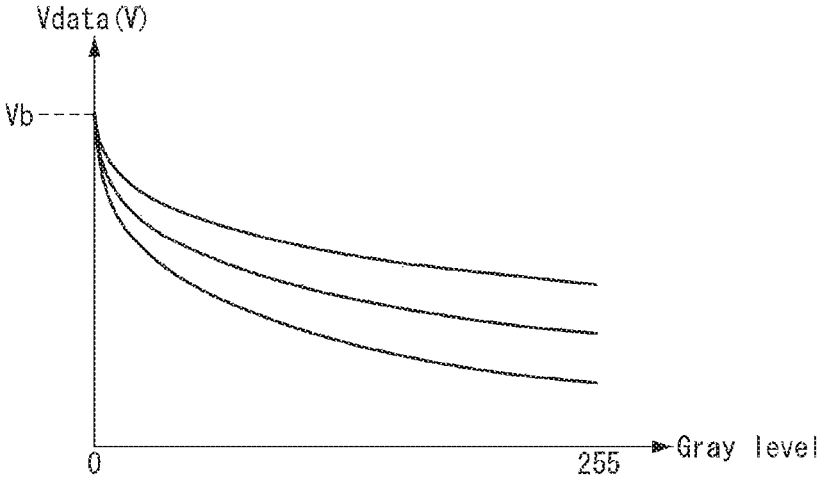
FIG. 5 shows black data voltages according to gray levels according to a comparative example.

As a result, in the related art device as shown in FIG. 5, a data driver displays a black image using only one black data voltage Vb. Further, in order to use the same black data voltage Vb, the magnitude of the black data voltage Vb should be set to be equal to or larger than the highest black data voltage among R, G and B black data voltages. For example, as shown in FIG. 5, the black data voltage Vb according to the related art is set to be equal to or larger than the G black data voltage G_Vb shown in FIG. 4 since the example of FIG. 4 shows the G black data voltage to be higher than the R or B black data voltage. So, in the process of displaying a black image, the R_DAC and the B_DAC of the related art data driver use larger voltage values than necessary, and thus consume more power than necessary.

In contrast, the gamma voltage generator 70 of the present invention can individually control the magnitudes of the R highest gamma voltage R_GMA1, the G highest gamma voltage G_GMA1, and the B highest gamma voltage B_GMA1. As a result, the R black data voltage R_Vb, the G black data voltage G_Vb, and the B black data voltage B_Vb for displaying black image can be individually adjusted. Since the magnitude of each of the R black data voltage R_Vb, G black data voltage G_Vb, and B black data voltage B_Vb is not set larger than necessary, the power consumption can be reduced and effectively controlled in the present invention.

The electrical stress of the driving transistor DT shown in FIG. 2 increases in proportion to the magnitude of the black data voltage. That is, since the threshold voltage shift phenomenon of the driving transistor DT increases in proportion to the magnitude of the black data voltage, the luminance deviation of the pixel occurs, which can cause a problem that residual image is displayed. The electrical stress of the driving transistor DT can be reduced by lowering the magnitude of the black data voltage, and as a result, the luminance deviation of the pixel P can be reduced.

Figure 6:
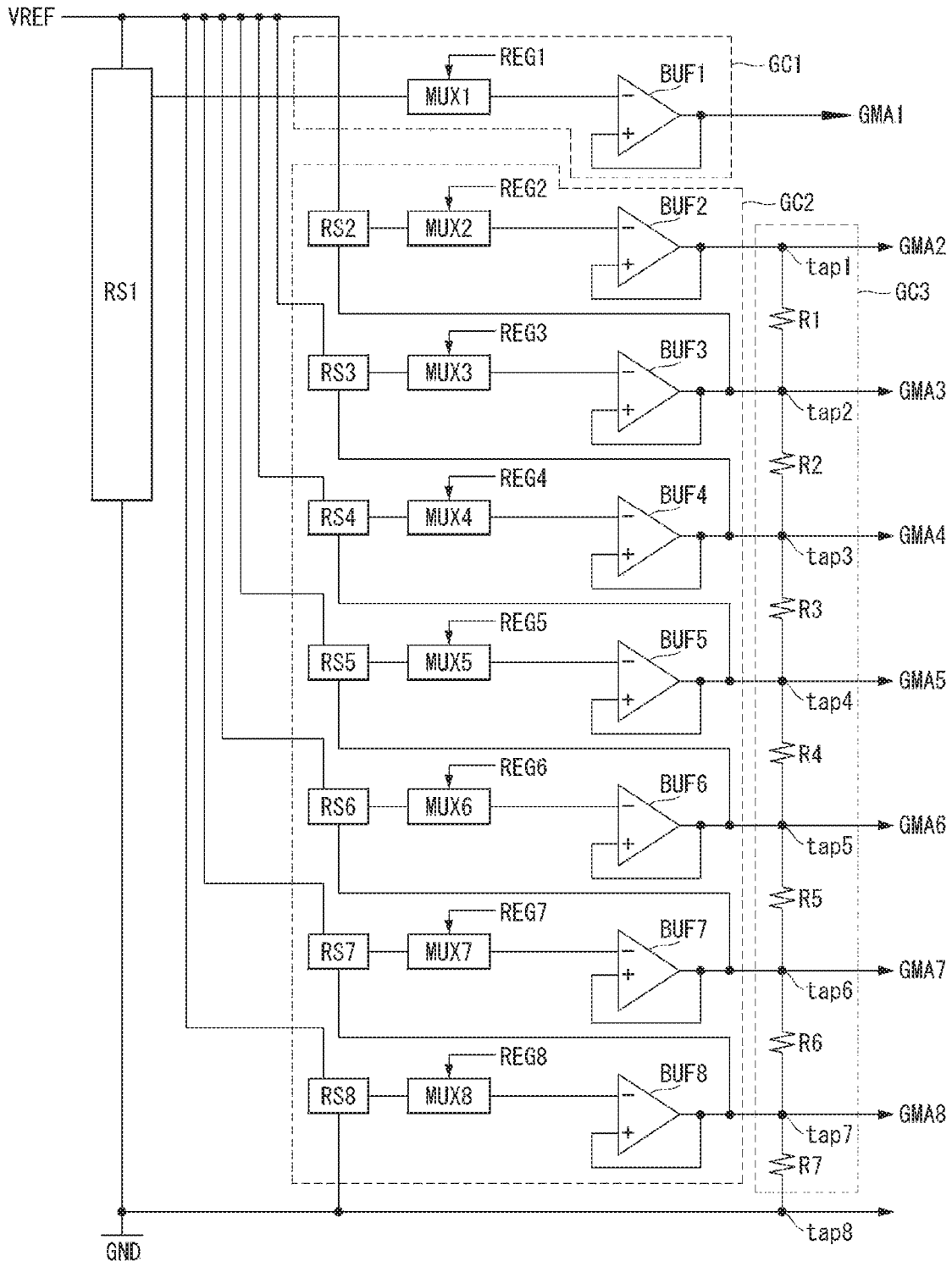
FIG. 6 is a diagram illustrating a gamma voltage generator according to an embodiment of the present disclosure.

FIG. 6 is a diagram illustrating an example of a gamma voltage generator according to an embodiment of the present disclosure. The R gamma voltage generator 71, the G gamma voltage generator 72 and the B gamma voltage generator 73 shown in FIG. 3 can be implemented by a same circuit, and can use different highest gamma register values. For example, the gamma voltage generator shown in FIG. 6 can be at least one of the R gamma voltage generator 71, the G gamma voltage generator 72 and the B gamma voltage generator 73 shown in FIG. 3. FIG. 6 shows an example in which the gamma voltage generator outputs eight gamma voltages. However, the number of gamma voltages output by each gamma voltage generator is not limited thereto and other variations are possible.

Referring to FIG. 6, the gamma voltage generator includes a first voltage dividing unit RS1 and first to third voltage dividing circuits GC1, GC2 and GC3, and generates a highest gamma voltage (also referred to herein as a first gamma voltage) GMA1, and second to eights gamma voltages GMA2 to GMA8.

The first voltage dividing circuit GC1 generates the first gamma voltage GMA1 based on the voltages output from the first voltage dividing unit RS1. For this, the first voltage dividing circuit GC1 includes a first multiplexer MUX1 and a first buffer BUF1.

The first voltage dividing unit RS1 can comprise a plurality of resistors each connected in series between the input terminal of a reference voltage VREF and the input terminal of a ground voltage GND. The first multiplexer MUX1 receives the voltages output from the first voltage dividing unit RS1 and outputs the voltage selected according to the highest gamma register value REG1 among the voltages output from the first voltage diving unit RS1. The first buffer BUF1 prevents a current flow from reversing, and smoothly transfers and outputs the first gamma voltage GMA1.

The second voltage dividing circuit GC2 divides the reference voltage VREF to generate the second to eighth gamma voltages GMA2 to GMA8. The second voltage dividing circuit GC2 comprises the second to eighth voltage dividing units RS2 to RS8, second to eighth multiplexers MUX2 to MUX8, and second to eighth buffers BUF2 to BUF8.

Each of the second to seventh voltage dividing units RS2 to RS7 receives the reference voltage VREF and the gamma voltage of a next stage, and divides the reference voltage VREF. The eighth voltage dividing unit RS8 receives the reference voltage VREF and the ground voltage and divides the reference voltage VREF. Each of the second to eighth voltage dividing units RS2 to RS8 can be constituted by a variable resistor. Respective second to eighth multiplexers MUX2 to MUX8 select one of the voltages output from the second to eighth voltage dividing units RS2 to RS8 as gamma voltages according to predetermined gamma register values REG2 to REG8. Respective second to eighth voltage dividing units RS2 to RS8 receive the reference voltage VREF and the gamma voltage of a next stage (next voltage dividing unit) to divide the reference voltage VREF. The second to eighth buffers BUF2 to BUF8 prevent a current flow from reversing, and smoothly transfer and output the second to eighth gamma voltages GMA2 to GMA8 respectively.

Specifically, the second voltage dividing unit RS2 receives the reference voltage VREF and the third gamma voltage GMA3, and divides the reference voltage VREF. The second multiplexer MUX2 selects one of the voltages which the second voltage dividing unit RS2 has divided according to the second gamma register value REG2, and outputs the selected voltage through the second buffer BUF2 as the second gamma voltage GMA2.

The third voltage dividing unit RS3 receives the reference voltage VREF and the fourth gamma voltage GMA4, and divides the reference voltage VREF. The third multiplexer MUX3 selects one of the voltages which the third voltage dividing unit RS3 has divided according to the third gamma register value REG3, and outputs the selected voltage through the third buffer BUF3 as the third gamma voltage GMA3.

The fourth voltage dividing unit RS4 receives the reference voltage VREF and the fifth gamma voltage GMA5, and divides the reference voltage VREF. The fourth multiplexer MUX4 selects one of the voltages which the fourth voltage dividing unit RS3 has divided according to the fourth gamma register value REG4, and outputs the selected voltage through the fourth buffer BUF4 as the fourth gamma voltage GMA4.

The fifth voltage dividing unit RS5 receives the reference voltage VREF and the sixth gamma voltage GMA6, and divides the reference voltage VREF. The fifth multiplexer MUX5 selects one of the voltages which the fifth voltage dividing unit RS5 has divided according to the fifth gamma register value REG5, and outputs the selected voltage through the fifth buffer BUF5 as the fifth gamma voltage GMA5.

The sixth voltage dividing unit RS6 receives the reference voltage VREF and the seventh gamma voltage GMA7, and divides the reference voltage VREF. The sixth multiplexer MUX6 selects one of the voltages which the sixth voltage dividing unit RS6 has divided according to the sixth gamma register value REG6, and outputs the selected voltage through the sixth buffer BUF6 as the sixth gamma voltage GMA6.

The seventh voltage dividing unit RS7 receives the reference voltage VREF and the eighth gamma voltage GMA8, and divides the reference voltage VREF. The seventh multiplexer MUX7 selects one of the voltages which the seventh voltage dividing unit RS7 has divided according to the seventh gamma register value REG7, and outputs the selected voltage through the seventh buffer BUF7 as the seventh gamma voltage GMA7.

The eighth voltage dividing unit RS8 receives the reference voltage VREF and the ground voltage GND, and divides the reference voltage VREF. The eighth multiplexer MUX8 selects one of the voltages which the eighth voltage dividing unit RS8 has divided according to the eighth gamma register value REG8, and outputs the selected voltage through the eighth buffer BUF8 as the eighth gamma voltage GMA8.

The first gamma register value REG1 can be selected to have a different value depending on the digital brightness value DBV. For example, since the gamma voltage generator (e.g., 71, 72 or 73 of the generator 70) of the present disclosure generates the first gamma voltage GMA1 based on the first gamma register value REG1, it is possible to vary the magnitude of the black data voltage representing the black gradation.

The third voltage dividing circuit GC3 includes first to seventh resistors R1 to R7, and each of the first to seventh resistors R1 to R7 is arranged between adjacent two taps of tap1 to tap7 which output the second to eighth gamma voltages GMA2 to GMA8. For example, the first resistor R1 is disposed between the first tap tap1 and the second tap tap2, and the seventh resistor R7 is disposed between the seventh tap tap7 and an eighth tap tap8. The third voltage dividing circuit GC3 ensures that the second to eighth gamma voltages GMA2 to GMA8 output through the respective taps tap1 to tap7 stably maintain their voltage levels.

As an embodiment, the first gamma voltage GMA1 can be varied according to the brightness which the display panel 100 represents. A method of varying the brightness of the display panel 100 and an example of controlling the first gamma voltage GMA1 will now be described below.

Figure 7:
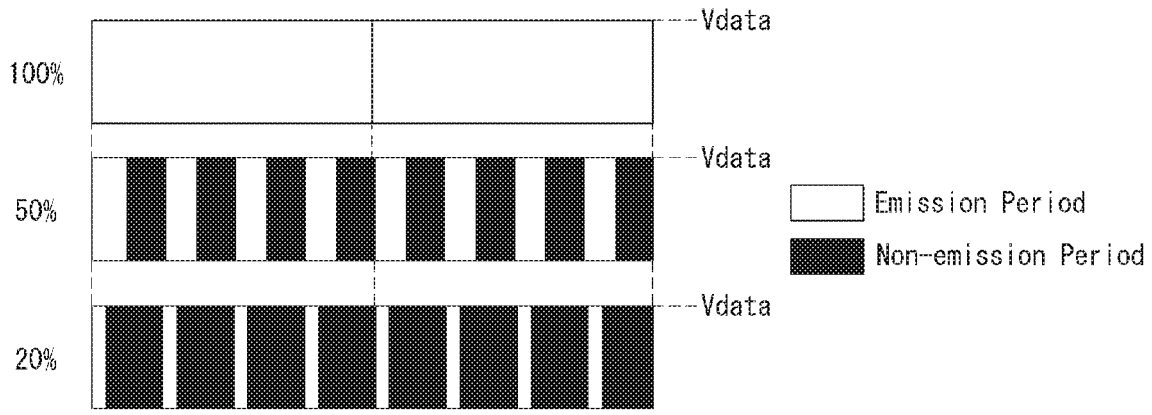
FIG. 7 is a view for explaining duty driving according to an example of the present disclosure.

FIG. 7 is a view for explaining duty driving according to an embodiment.

Referring to FIG. 7, the organic light emitting display device according to the present disclosure varies the brightness of the display panel 100 by using the duty driving, e.g., by changing the emission period and non-emission period of the pixels for each frame period.

The duty driving can operate according to a user's setting or the conditions preset in a display device. In the duty driving, a duty ratio can be defined as a ratio of a light emission period to one frame period. So, as shown in the example of FIG. 7, when the duty ratio is 100%, pixels continuously maintain their emission states for one frame period. When the duty ratio is 50% for example, the emission period and the non-emission period of pixels become 1:1, and when the duty ratio is 20% for example, the emission period and the non-emission period of pixels become 1:4.

Figure 8:
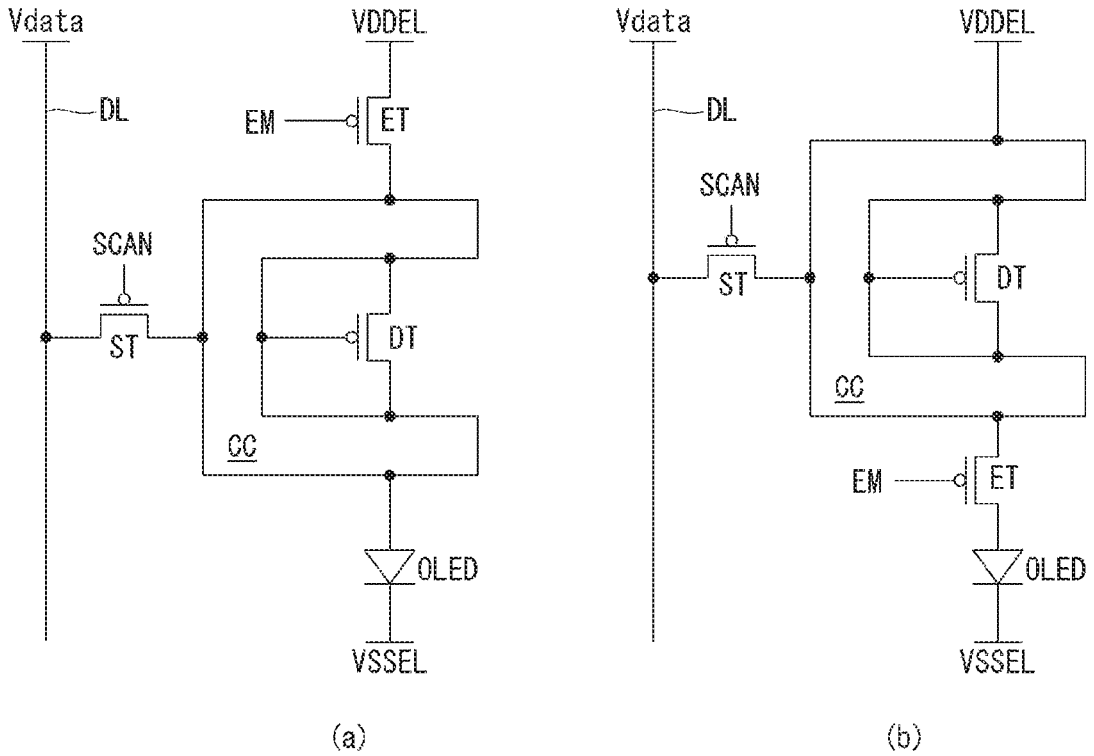
FIG. 8 shows an example of a pixel structure for duty driving according to the present disclosure.

FIG. 8 shows examples of a pixel structure for the duty driving according to an example of the present disclosure.

The duty driving of FIGS. 7 and 8 is applied to the display devices of FIGS. 1-4 and 6, but obviously can be applied to other display devices disclosed in the present disclosure. For example, the duty driving will be applied to each pixel having the configuration shown in (a) or (b) of FIG. 8.

Referring to FIG. 8, the pixel (e.g., P) comprises the OLED, the driving transistor DT, the scan transistor ST, an emission control transistor ET, and the compensation circuit CC.

The OLED includes an organic compound layer located between an anode electrode and a cathode electrode, and the cathode electrode is connected to the input terminal of a low potential driving voltage VSSEL. The driving transistor DT controls the driving current applied to the OLED according to its source-gate voltage Vsg. The scan transistor ST provides the data voltage Vdata from the data line DL to the compensation circuit CC in response to the scan signal SCAN. The scan transistor ST can connect the data line DL to the gate electrode, the source electrode or the drain electrode of the driving transistor DT. The compensation circuit CC samples the threshold voltage of the driving transistor DT and causes the OLED to emit light while excluding the effect of the threshold voltage of the driving transistor DT based on the sampled value. The emission control transistor ET can be connected between the source electrode of the driving transistor DT and the input terminal of a high potential driving voltage VDDEL as shown in (a) of FIG. 8 or between the drain electrode of the driving transistor DT and the input terminal of the low potential driving voltage VSSEL as shown in (b) of FIG. 8. During an emission period, the emission control signal EM maintains a turn-on voltage, and the driving current flowing from the input terminal of the high potential driving voltage VDDEL through the driving transistor DT can flow into the anode electrode of the OLED. The emission control signal EM maintains a turn-off voltage during a non-emission period of the duty driving.

Figure 9:
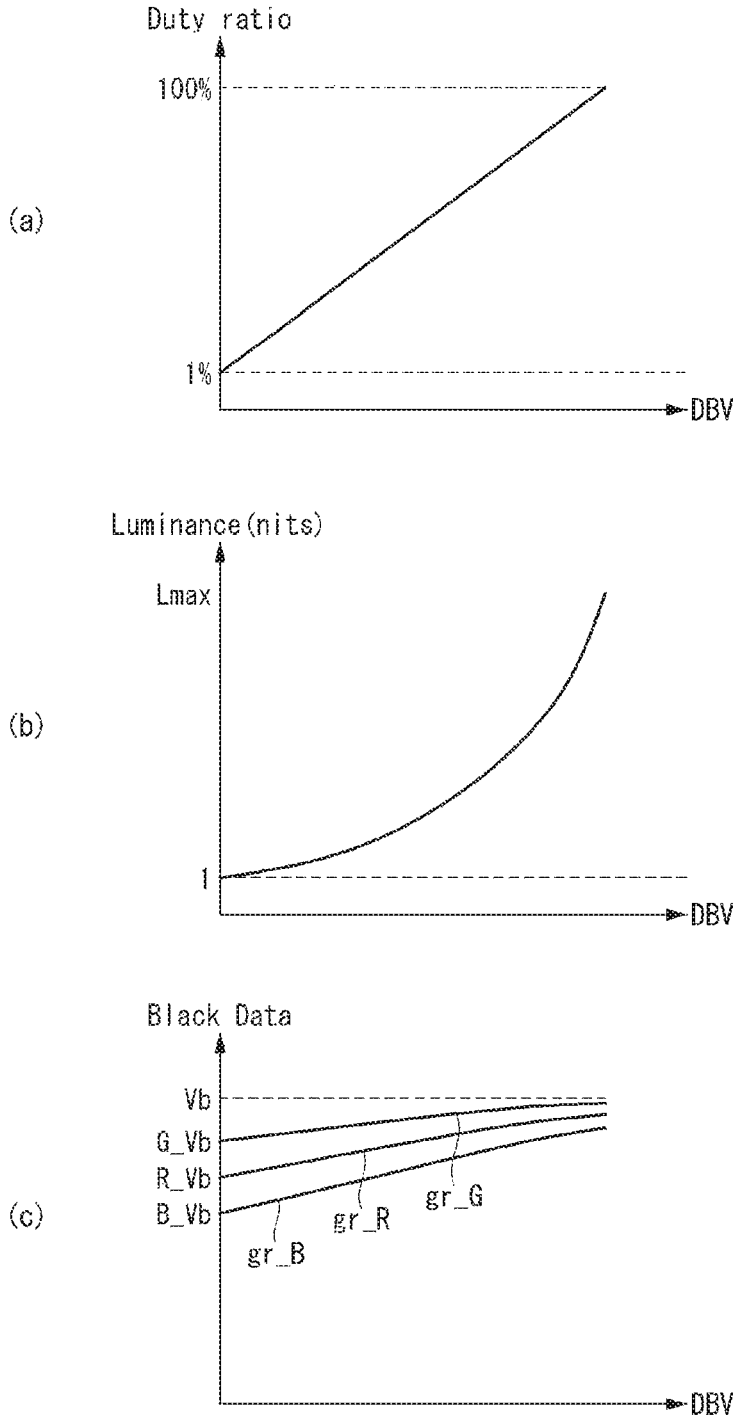
FIGS. 9 and 10 are diagrams for explaining a method of varying a black data voltage according to a luminance value according to an example of the present disclosure.

FIG. 9 is a diagram for explaining a method of adjusting a black data voltage according to a digital brightness value. A method of adjusting the black data voltage with reference to the above-described figures and FIG. 9 will be described below.

Referring to (a) of FIG. 9, the duty ratio is proportional to the digital brightness value DBV. And, as shown in (b) of FIG. 9, the brightness of the display panel 100 increases in proportional to the duty ratio/DBV.

The gamma voltage generator 70 adjusts the magnitude of the first gamma voltage GMA1 in proportional to the digital brightness value DBV. That is, as displaying lower luminance according to the DBV, the gamma voltage generator 70 decreases the magnitude of the first gamma voltage GMA1. For each digital brightness value DBV, the G highest gamma voltage G_GMA1 is set to be the highest magnitude, and the B highest gamma voltage B_GMA1 is set to be the lowest magnitude. As a result, as shown in (c) of FIG. 9, the data driver 30 decreases the magnitudes of the black data voltages G_Vb, R_Vb, and B_Vb as the digital brightness value DBV becomes smaller.

The emission duty ratio for a low brightness value is set to be small, so the emission period of the pixels in the display panel 100 is shortened. Because the emission period is shortened, even if decreasing the magnitudes of the black data voltages G_Vb, R_Vb, and B_Vb for a low brightness value DBV, gradation representation is hardly affected. As described above, power consumption can be reduced by decreasing the output range of the data driver 30 when driving low brightness.

Figure 10:
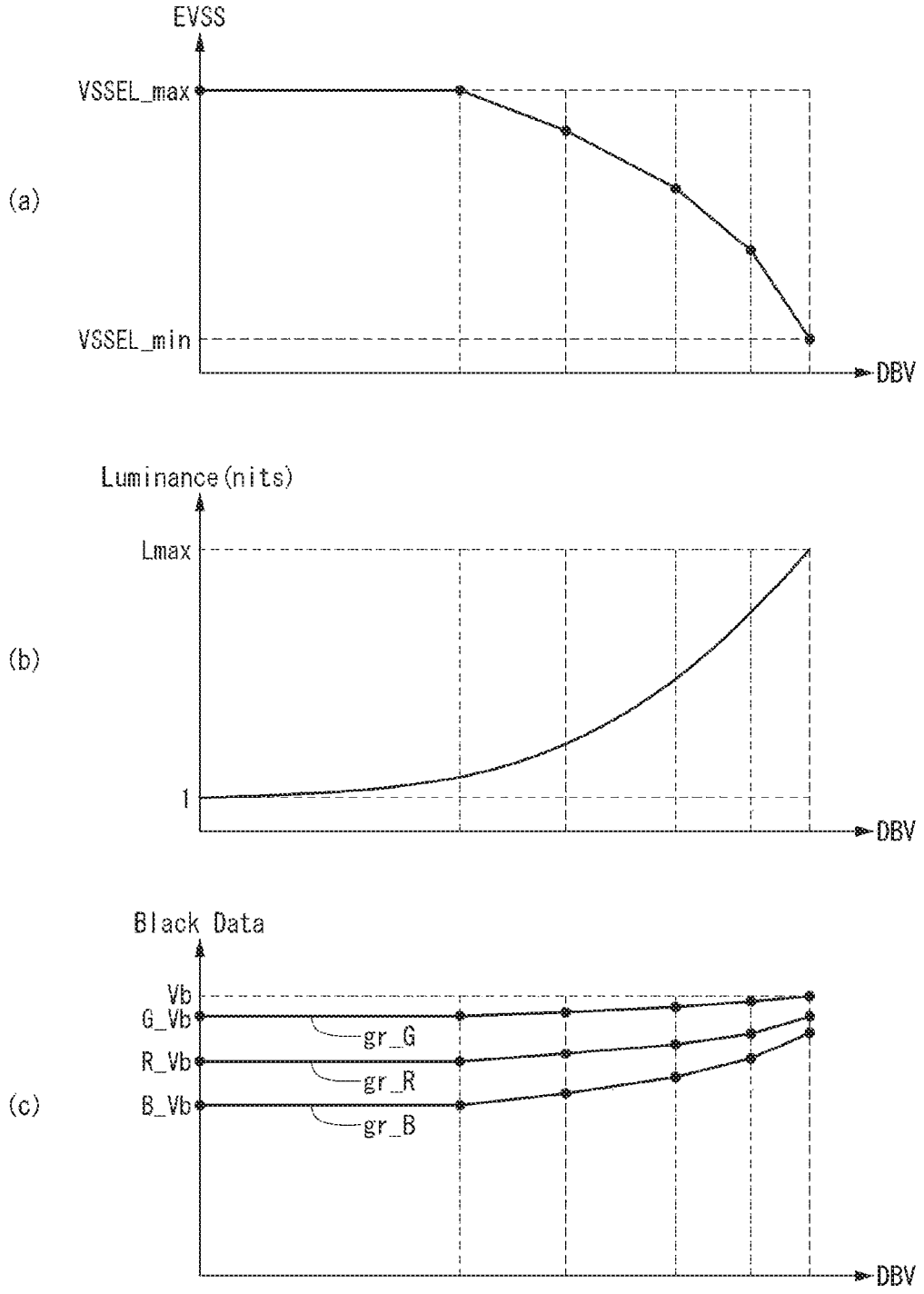

FIG. 10 shows a diagram for explaining a method of adjusting the highest gamma voltage according to another embodiment.

Referring to (a) and (b) of FIG. 10, the voltage generator 90 varies the low potential driving voltage VSSEL according to the digital brightness value DBV. As the magnitude of the absolute value of the low potential driving voltage VSSEL becomes smaller, the driving current flowing to the OLED decreases so the brightness becomes lowered. Therefore, when the digital brightness value DBV is small, it is not necessary to increase the magnitude of the absolute value of the low potential driving voltage VSSEL, and power consumption can be reduced by decreasing the magnitude of the absolute value of the low potential driving voltage VSSEL.

If the magnitude of the absolute value of the low potential driving voltage VSSEL becomes small, the drain-source voltage Vds of the driving transistor DT becomes small. If the drain-source voltage Vds of the driving transistor DT becomes small, the amount of change in brightness relative to the amount of change in the data voltage decreases. That is, if the magnitude of the absolute value of the low potential driving voltage VSSEL becomes small, resolution can be ensured in a low gradation region As described above, when the digital brightness value DBV is lowered, the voltage generator 90 can reduce the magnitude of the absolute value of the low potential driving voltage VSSEL and secure the resolution in the low gradation region while reducing power consumption.

If the low potential driving voltage VSSEL is below 0V, as shown in (a) of FIG. 10, the voltage generator 90 can decrease the magnitude of the absolute value of the low potential driving voltage VSSEL by increasing the low potential driving voltage VSSEL as the digital brightness value DBV becomes smaller.

At the same time, the gamma voltage generator 70 adjusts the magnitude of the first gamma voltage GMA1 in proportion to the digital brightness value DBV. As a result, the data driver 30 lowers the magnitude of the black data voltages G_Vb, R_Vb, and B_Vb as the digital brightness value DBV becomes smaller, as shown in (c) of FIG. 10.

Similar to the embodiment of FIG. 9, according to the embodiment shown in FIG. 10, when driving the display device at low brightness, power consumption can be reduced by making the output range of the data driver 30 small.

The display device according to an embodiment of the present disclosure can include a liquid crystal display device LCD, a field emission display device FED, an organic light emitting display device OLED, and a Quantum Dot Display Apparatus QD.

The display device according to an embodiment of the present disclosure can include a complete product or a final product including an LCD, an OLED module, etc. such as a notebook computer, a television, a computer monitor and an automotive apparatus, an equipment apparatus including other types of vehicle, a set electronic apparatus such as a mobile electronic apparatus including a smart phone or an electronic pad, and a set apparatus.

The display device according to the embodiment(s) of the present disclosure can be described as follows.

The display device of the present disclosure can comprise a display panel, a gamma voltage generator and a data driver. The display panel is equipped with data lines, gate lines which cross the data lines, and pixels. The gamma voltage generator generates first to nth gamma voltages. The data driver generates data voltages by selecting the gamma voltages according to input image data and supplies the data voltages to the data lines. The gamma voltage generator comprises a first voltage dividing unit for dividing a first reference voltage, a first voltage dividing circuit for generating the first gamma voltage by selecting the voltages output from the first voltage dividing unit according to a highest gamma register value, and a second voltage dividing circuit for generating the second to nth gamma voltages by dividing the first reference voltage.

In an embodiment, the first voltage dividing can comprise a first multiplexer for selecting one of the voltages output from the first voltage dividing unit in response to the highest gamma register value.

In an embodiment, the highest gamma register value can be used for representing black gradation.

In an embodiment, the gamma voltage generator can comprise an R gamma voltage generator, a G gamma voltage generator, and a B gamma voltage generator. Each of the R gamma voltage generator, the G gamma voltage generator, and the B gamma voltage generator includes the first multiplexer, and the first multiplexer included in one of the R gamma voltage generator, the G gamma voltage generator, and the B gamma voltage generator is supplied with the highest gamma register value which is distinct from the highest gamma register value supplied to the first multiplexer included in another of the R gamma voltage generator, the G gamma voltage generator, and the B gamma voltage generator.

In an embodiment, the data driver can comprise an R digital-to-analog converter DAC configured to generate an R black data voltage based on the first gamma voltage output from the R gamma voltage generator; a G DAC configured to generate a G black data voltage based on the first gamma voltage output from the G gamma voltage generator; and a B DAC configured to generate a B black data voltage based on the first gamma voltage output from the B gamma voltage generator. The G black data voltage output from the G DAC can have a voltage level higher than the R black data voltage and the B black data voltage.

In an embodiment, the display device can further comprise a timing controller configured to control driving timings of the data driver and to control a duty ratio in proportional to a brightness value. The data driver is configured to adjust one of the R black data voltage, the G black data voltage, and the B black data voltage to be larger in proportional to the brightness value.

In an embodiment, the pixel includes an organic light emitting diode emitting light in response to a driving current flowing from a driving transistor, and a magnitude of a low potential driving voltage supplied to a cathode electrode of the organic light emitting diode is adjusted to be larger in proportional to the brightness value.

In an embodiment, a gamma register is configured to store a plurality of different gamma register values provided depending on gamma bands, and the highest gamma register value is included in the plurality of different gamma register values stored in the gamma register.

In an embodiment, a driving device for driving a display device including a red (R) pixel, a green (G) pixel, and a blue (B) pixel, comprises a gamma voltage generator configured to generate a plurality of gamma voltages, the gamma voltage generator includes an R gamma voltage generator, a G gamma voltage generator, and a B gamma voltage generator, and the R, G and B gamma voltage generators generate respectively R, G and B highest gamma voltages, and the R, G and B highest gamma voltages are different from each other. The driving device further comprises a data driver configured to generate a first black data voltage, a second black data voltage, and a third black data voltage respectively based on the R, G and B highest gamma voltages, and supply the first, second and third black data voltages respectively to the R, G and B pixels.

In an embodiment, at least one of the R, G and B gamma voltage generators includes a first voltage dividing unit configured to divide a reference voltage, a first voltage dividing circuit configured to generate the R, G or B highest gamma voltage by selecting voltages output from the first voltage dividing unit according to a highest gamma register value, and a second voltage dividing circuit configured to generate other gamma voltages using the reference voltage.

In an embodiment, the first voltage dividing circuit comprises a first multiplexer for selecting one of the voltages output from the first voltage dividing unit in response to the highest gamma register value.

In an embodiment, the highest gamma register value is used for representing black gradation.

In an embodiment, each of the R gamma voltage generator, the G gamma voltage generator, and the B gamma voltage generator includes the first voltage dividing unit, the first voltage diving circuit and the second voltage diving circuit.

In an embodiment, the data driver comprises an R digital-to-analog converter (DAC) configured to generate the first black data voltage based on the R highest gamma voltage, a G DAC configured to generate the second black data voltage based on the G highest gamma voltage; and a B DAC configured to generate the third black data voltage based on the B highest gamma voltage.

In an embodiment, the second black data voltage output from the G DAC has a voltage level higher than the first and third black data voltages.

In an embodiment, a timing controller is configured to control driving timings of the data driver and to control a duty ratio in proportional to a brightness value, and the data driver is configured to adjust one of the first, second and third black data voltage to be larger in proportional to the brightness value.

In an embodiment, at least one of the R, G and B pixels includes an organic light emitting diode emitting light in response to a driving current flowing from a driving transistor, and a magnitude of a low potential driving voltage supplied to a cathode electrode of the organic light emitting diode is adjusted to be larger in proportional to the brightness value.

Throughout the description, it should be understood by those skilled in the art that various changes and modifications are possible without departing from the technical principles of the present disclosure. Therefore, the technical scope of the present disclosure is not limited to the detailed descriptions in this specification but should be defined by the scope of the appended claims.

What is claimed is:

1. A display device, comprising:

a display panel including data lines, gate lines which cross the data lines, and pixels;

a gamma voltage generator configured to generate first to nth gamma voltages, n being an integer; and a data driver configured to generate data voltages by selecting the gamma voltages according to input image data, and to supply the data voltages to the data lines, wherein the gamma voltage generator comprises:

a first voltage dividing unit configured to divide a reference voltage;

a first voltage dividing circuit configured to generate the first gamma voltage by selecting voltages output from the first voltage dividing unit according to a highest gamma register value; and a second voltage dividing circuit configured to generate the second to nth gamma voltages using the reference voltage, wherein the gamma voltage generator comprises a red (R) gamma voltage generator, a green (G) gamma voltage generator, and a blue (B) gamma voltage generator, and wherein one of the R gamma voltage generator, the G gamma voltage generator, the B gamma voltage generator is supplied with the highest gamma register value which is different from the highest gamma register value supplied to another of the R gamma voltage generator, the G gamma voltage generator, and the B gamma voltage generator.

2. The display device of claim 1, wherein the first voltage dividing circuit comprises a first multiplexer for selecting one of the voltages output from the first voltage dividing unit in response to the highest gamma register value.

3. The display device of claim 2, wherein the highest gamma register value is used for representing black gradation.

4. The display device of claim 3, wherein each of the R gamma voltage generator, the G gamma voltage generator, and the B gamma voltage generator includes the first multiplexer and generates a first gamma voltage.

5. The display device of claim 4, wherein the first multiplexer included in one of the R gamma voltage generator, the G gamma voltage generator, and the B gamma voltage generator is supplied directly with the highest gamma register value which is different from the highest gamma register value directly supplied to the first multiplexer included in another of the R gamma voltage generator, the G gamma voltage generator, and the B gamma voltage generator.

6. The display device of claim 4, wherein the data driver comprises:

an R digital-to-analog converter (DAC) configured to generate an R black data voltage based on the first gamma voltage output from the R gamma voltage generator;

a G DAC configured to generate a G black data voltage based on the first gamma voltage output from the G gamma voltage generator; and a B DAC configured to generate a B black data voltage based on the first gamma voltage output from the B gamma voltage generator.

7. The display device of claim 6, wherein the G black data voltage output from the G DAC has a voltage level higher than the R black data voltage and the B black data voltage.

8. The display device of claim 6, further comprising:

a timing controller configured to control driving timings of the data driver and to control a duty ratio in proportional to a brightness value, wherein the data driver is configured to adjust one of the R black data voltage, the G black data voltage, and the B black data voltage to be larger in proportional to the brightness value.

9. The display device of claim 8, wherein at least one of the pixels includes an organic light emitting diode emitting light in response to a driving current flowing from a driving transistor, and wherein a magnitude of a low potential driving voltage supplied to a cathode electrode of the organic light emitting diode is adjusted to be larger in proportional to the brightness value.

10. The display device of claim 1, further comprising a gamma register configured to store a plurality of different gamma register values provided depending on gamma bands, wherein the highest gamma register value is included in the plurality of different gamma register values stored in the gamma register.

11. A driving device for driving a display device including a red (R) pixel, a green (G) pixel, and a blue (B) pixel, the driving device comprising:

a gamma voltage generator configured to generate a plurality of gamma voltages, wherein the gamma voltage generator includes an R gamma voltage generator, a G gamma voltage generator, and a B gamma voltage generator, and wherein the R, G and B gamma voltage generators generate respectively R, G and B highest gamma voltages, and the R, G and B highest gamma voltages are different from each other; and a data driver configured to generate a first black data voltage, a second black data voltage, and a third black data voltage respectively based on the R, G and B highest gamma voltages, and supply the first, second and third black data voltages respectively to the R, G and B pixel, wherein one of the R, G and B gamma voltage generators is supplied with the highest gamma register value which is different from the highest gamma register value supplied to another of the R, G and B gamma voltage generators.

12. The driving device of claim 11, wherein at least one of the R, G and B gamma voltage generators includes:

a first voltage dividing unit configured to divide a reference voltage;

a first voltage dividing circuit configured to generate the R, G or B highest gamma voltage by selecting voltages output from the first voltage dividing unit according to a highest gamma register value; and a second voltage dividing circuit configured to generate other gamma voltages using the reference voltage.

13. The driving device of claim 12, wherein the first voltage dividing circuit comprises a first multiplexer for selecting one of the voltages output from the first voltage dividing unit in response to the highest gamma register value.

14. The driving device of claim 13, wherein the highest gamma register value is used for representing black gradation.

15. The driving device of claim 12, wherein each of the R gamma voltage generator, the G gamma voltage generator, and the B gamma voltage generator includes the first voltage dividing unit, the first voltage diving circuit and the second voltage diving circuit.

16. The driving device of claim 11, wherein the data driver comprises:

an R digital-to-analog; converter (DAC) configured to generate the first black data voltage based on the R highest gamma voltage;

a G DAC configured to generate the second black data voltage based on the G highest gamma voltage; and a B DAC configured to generate the third black data voltage based on the B highest gamma voltage.

17. The driving device of claim 16, wherein the second black data voltage output from the G DAC has a voltage level higher than the first and third black data voltages.

18. The driving device of claim 11, further comprising:

a timing controller configured to control driving timings of the data driver and to control a duty ratio in proportional to a brightness value, wherein the data driver is configured to adjust one of the first, second and third black data voltage to be larger in proportional to the brightness value.

19. The driving device of claim 18, wherein at least one of the R, G and B pixels includes an organic light emitting diode emitting light in response to a driving current flowing from a driving transistor, and wherein a magnitude of a low potential driving voltage supplied to a cathode electrode of the organic light emitting diode is adjusted to be larger in proportional to the brightness value.

20. The driving device of claim 12, further comprising a gamma register configured to store a plurality of different gamma register values provided depending on gamma bands, wherein the highest gamma register value is included in the plurality of different gamma register values stored in the gamma register.

* * * * *